US012123599B2

(12) United States Patent
Jang et al.

(10) Patent No.: US 12,123,599 B2
(45) Date of Patent: Oct. 22, 2024

(54) COOKING APPARATUS

(71) Applicant: Samsung Electronics Co., Ltd., Suwon-si (KR)

(72) Inventors: Hyeongjin Jang, Suwon-si (KR); Jonghoon Lee, Suwon-si (KR); Sangho Lee, Suwon-si (KR); Byounghoon Moon, Suwon-si (KR); Heesoo Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 214 days.

(21) Appl. No.: 17/155,510

(22) Filed: Jan. 22, 2021

(65) Prior Publication Data

US 2021/0231309 A1 Jul. 29, 2021

(30) Foreign Application Priority Data

Jan. 23, 2020 (KR) ..... 10-2020-0009470

(51) Int. Cl.
*F24C 7/08* (2006.01)
*F24C 15/00* (2006.01)
*F24C 15/08* (2006.01)

(52) U.S. Cl.
CPC ..... *F24C 7/082* (2013.01); *F24C 15/006* (2013.01); *F24C 15/08* (2013.01)

(58) Field of Classification Search
CPC ..... F24C 7/082; F24C 15/006; F24C 15/08; F24C 3/126; F24C 15/06; F24C 15/12
See application file for complete search history.

(56) References Cited

U.S. PATENT DOCUMENTS 3,659,579 A * 5/1972 Henderson ..... F24C 15/006 126/41 R
3,889,100 A * 6/1975 Dills ..... F24C 15/006 219/393

(Continued)

FOREIGN PATENT DOCUMENTS

EP 3217098 A1 * 9/2017
KR 20-0386575 Y1 6/2005

(Continued)

OTHER PUBLICATIONS

International Search Report for International Patent Application No. PCT/KR2021/000902 dated Apr. 19, 2021.

(Continued)

*Primary Examiner* — Helena Kosanovic
*Assistant Examiner* — Thao Uyen Tran-Le
(74) *Attorney, Agent, or Firm* — STAAS & HALSEY LLP

(57) ABSTRACT

Provided is a cooking apparatus. The cooking apparatus includes a main body forming an electric room, a heating device arranged in the main body, and a control panel configured to control the heating device, wherein the control panel comprises a glass panel, a knob holder including a holder bracket arranged on one side of the glass panel and a holder case coupleable to the holder bracket and arrange on another side of the glass panel such that while the holder case is coupled to the holder bracket, the glass panel is between the holder bracket and the holder case, and a knob having a portion to be received in the knob holder.

16 Claims, 12 Drawing Sheets

(56) References Cited

U.S. PATENT DOCUMENTS

| | | | | |
|---|---|---|---|---|
| 5,474,055 | A * | 12/1995 | Kang | F24C 15/34 126/39 C |
| 6,172,338 | B1 * | 1/2001 | Barnes | F24C 15/006 219/400 |
| 8,979,289 | B2 | 3/2015 | Camli et al. | |
| 9,146,033 | B2 | 9/2015 | Cadima et al. | |
| 10,054,315 | B2 | 8/2018 | Choi | |
| 10,174,951 | B2 | 1/2019 | Choi | |
| 10,281,154 | B2 | 5/2019 | Yantis | |
| 2007/0131220 | A1 * | 6/2007 | Kim | H05B 6/642 126/273 R |
| 2007/0158340 | A1 * | 7/2007 | Kim | F24C 15/04 126/198 |
| 2008/0081197 | A1 * | 4/2008 | Huang | F24C 7/082 428/426 |
| 2009/0107479 | A1 * | 4/2009 | Armstrong | F24C 15/006 126/21 A |
| 2011/0290783 | A1 * | 12/2011 | Geiger | F24C 15/10 248/224.8 |
| 2012/0266758 | A1 * | 10/2012 | Lee | F24C 3/085 99/357 |
| 2016/0097541 | A1 * | 4/2016 | Choi | G05G 1/08 126/39 N |
| 2016/0327283 | A1 | 11/2016 | Lee et al. | |
| 2017/0191671 | A1 * | 7/2017 | Chambers | F24C 3/126 |
| 2018/0010932 | A1 * | 1/2018 | Bach | G01D 5/3473 |
| 2018/0238551 | A1 * | 8/2018 | Ha | G05G 1/12 |
| 2019/0212014 | A1 * | 7/2019 | Chadwick | F24C 15/02 |
| 2019/0301744 | A1 | 10/2019 | Yang | |
| 2020/0271326 | A1 * | 8/2020 | Kozinski | F24C 3/124 |

FOREIGN PATENT DOCUMENTS

| | | |
|---|---|---|
| KR | 10-0698204 | 3/2007 |
| KR | 10-2016-0075259 | 6/2016 |
| KR | 10-1654725 | 9/2016 |
| KR | 10-2018-0095439 A | 8/2018 |
| KR | 10-1913927 B1 | 10/2018 |
| KR | 10-2019-0138070 A | 12/2019 |

OTHER PUBLICATIONS

Korean Office Action dated Jul. 1, 2021, for Korean Application No. 10-2020-0009470.

* cited by examiner

COOKING APPARATUS

CROSS-REFERENCE TO RELATED APPLICATION

This application is based on and claims priority under 35 U. S. C. § 119 to Korean Patent Application No. 10-2020-0009470 filed on Jan. 23, 2020, the disclosure of which is incorporated herein by reference in its entirety.

BACKGROUND

1. Field

The disclosure relates to cooking apparatuses, and more particularly to a cooking apparatus with an improved structure.

2. Discussion of Related Art

Cooking apparatuses are home appliances typically equipped with a cooking room, a heating device for applying heat to the cooking room, and a circulation device for circulating the heat produced by the heating device inside the cooking room to cook food.

The cooking apparatuses cook food by sealing up and heating food, and may be generally classified by their heating sources into electric, gas, and microwave types.

For example, an electric oven uses an electric heater as the heating source, and gas and microwave ovens respectively use heat from gas and frictional heat of water molecules at high frequencies as the heating source.

The cooking apparatus may include a control panel on one of front and top surfaces of the main body. The control panel may include a number of buttons, a keypad, knobs, etc., for setting up cooking modes desired by the user and various conditions required for cooking. In addition, to enhance the design, the cooking apparatus may include a knob holder enclosing the knob and a glass panel defining the front surface of the control panel.

SUMMARY

In accordance with an aspect of the disclosure, a cooking apparatus includes a main body forming an electric room, a heating device arranged in the main body, and a control panel configured to control the heating device, wherein the control panel comprises a glass panel, a knob holder including a holder bracket arranged on one side of the glass panel and a holder case coupleable to the holder bracket and arrange on another side of the glass panel such that while the holder case is coupled to the holder bracket, the glass panel is between the holder bracket and the holder case, and a knob having a portion to be received in the knob holder.

The glass panel may include a holder coupling hole formed for the knob holder to be coupled to the glass panel, and a circumference of the holder coupling hole may be smaller than a circumference of the knob holder.

The knob holder may be arranged to support the glass panel on both the one side and the other side of the glass panel.

The holder case may include a knob receiver formed to cover at least the portion of the knob received in the holder case, and the portion of the knob received in the holder case is a portion of edges of the knob.

The knob holder may include an opening for a valve to be coupled to the knob to pass through, the holder case may include a holder coupler, and the holder bracket may be coupled to the holder coupler and the holder bracket may include a bracket installation part located outside of edges of the opening.

The control panel may include a panel chassis arranged to support the glass panel.

The holder bracket may be fixed to the panel chassis.

The control panel may include a cover chassis coupled to an end of the panel chassis to support the glass panel.

The cover chassis may include a first chassis coupled to the end of the panel chassis to support an end of the glass panel, and a second chassis coupled to another end of the panel chassis to support another end of the glass panel.

The panel chassis may be formed to include a material different from the cover chassis.

The control panel may include an inlet formed between the panel chassis and the cover chassis, the main body may include an outlet formed at an end opposite another end of the main body at which the control panel is arranged, and a wind blower may be arranged on a flow path connecting the inlet and the outlet for circulating air.

The inlet may be formed towards a direction of gravity.

The panel chassis may include a cooling slit formed to guide air brought in through the inlet to the electric room.

The cover chassis may include a blocking portion extending to block a foreign material from being brought in through the inlet.

The inlet may be formed at a location corresponding to where electric parts are arranged in the electric room.

In accordance with another aspect of the disclosure, a cooking apparatus includes a heating device, and a control panel configured to control the heating device, wherein the control panel includes a glass panel: a knob holder arranged to support the glass panel on one side of the glass panel and another side of the glass panel, and a knob having a portion to be received in the knob holder.

The control panel may include an inlet formed towards a direction of gravity, and a blocking portion extending to block a foreign material from being brought in through the inlet.

The inlet may be arranged to correspond to a location of an electric part mounted on the control panel.

The glass panel may include a holder coupling hole formed for the knob holder to be coupled to the glass panel, and a circumference of the holder coupling hole may be smaller than a circumference than the knob holder.

The control panel may include a panel chassis supporting one side of the glass panel, and a cover chassis supporting the other side of the glass panel.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
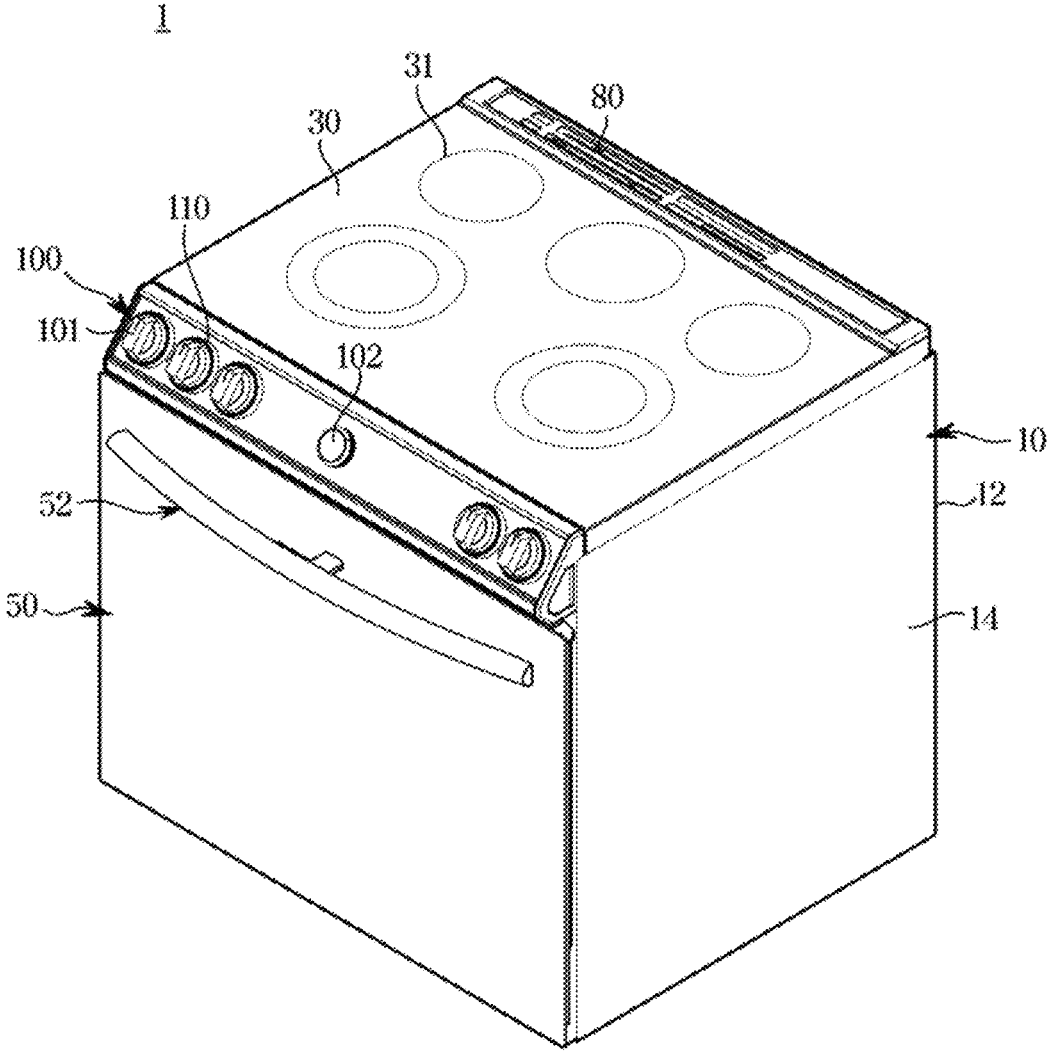
FIG. 1 shows a cooking apparatus, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Reference will now be made in detail to embodiments of the disclosure, which are illustrated in the accompanying drawings, wherein like reference numerals refer to the like elements throughout.

The disclosure provides a cooking apparatus having an enhanced design.

The disclosure also provides a cooking apparatus having a glass panel with a reduced defective rate, enabling reduction in cost.

The disclosure also provides a cooking apparatus capable of efficiently cooling electric parts inside a control panel.

Figure 2:
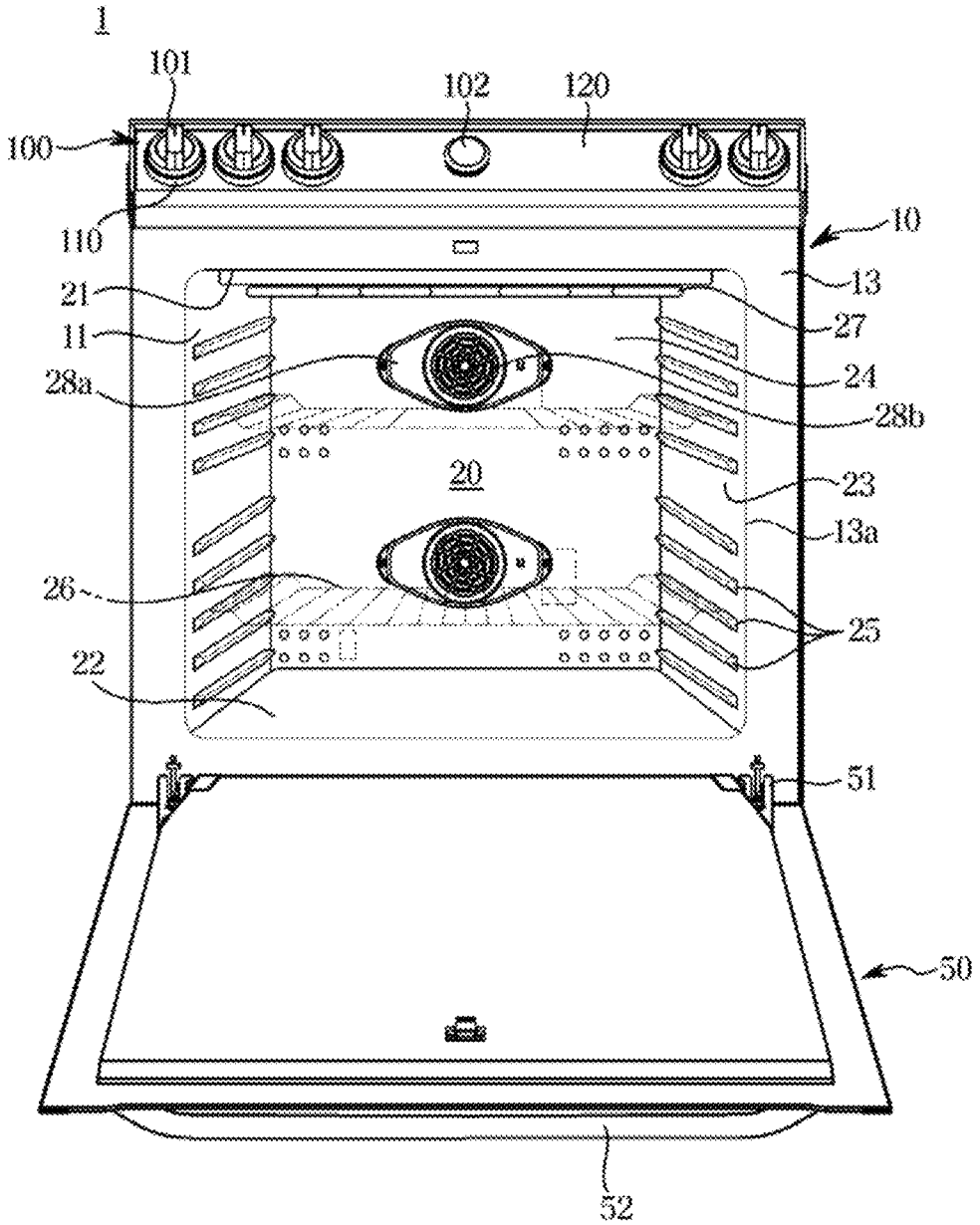
FIG. 2 shows the cooking apparatus shown in FIG. 1 with a door open.
Figure 3:
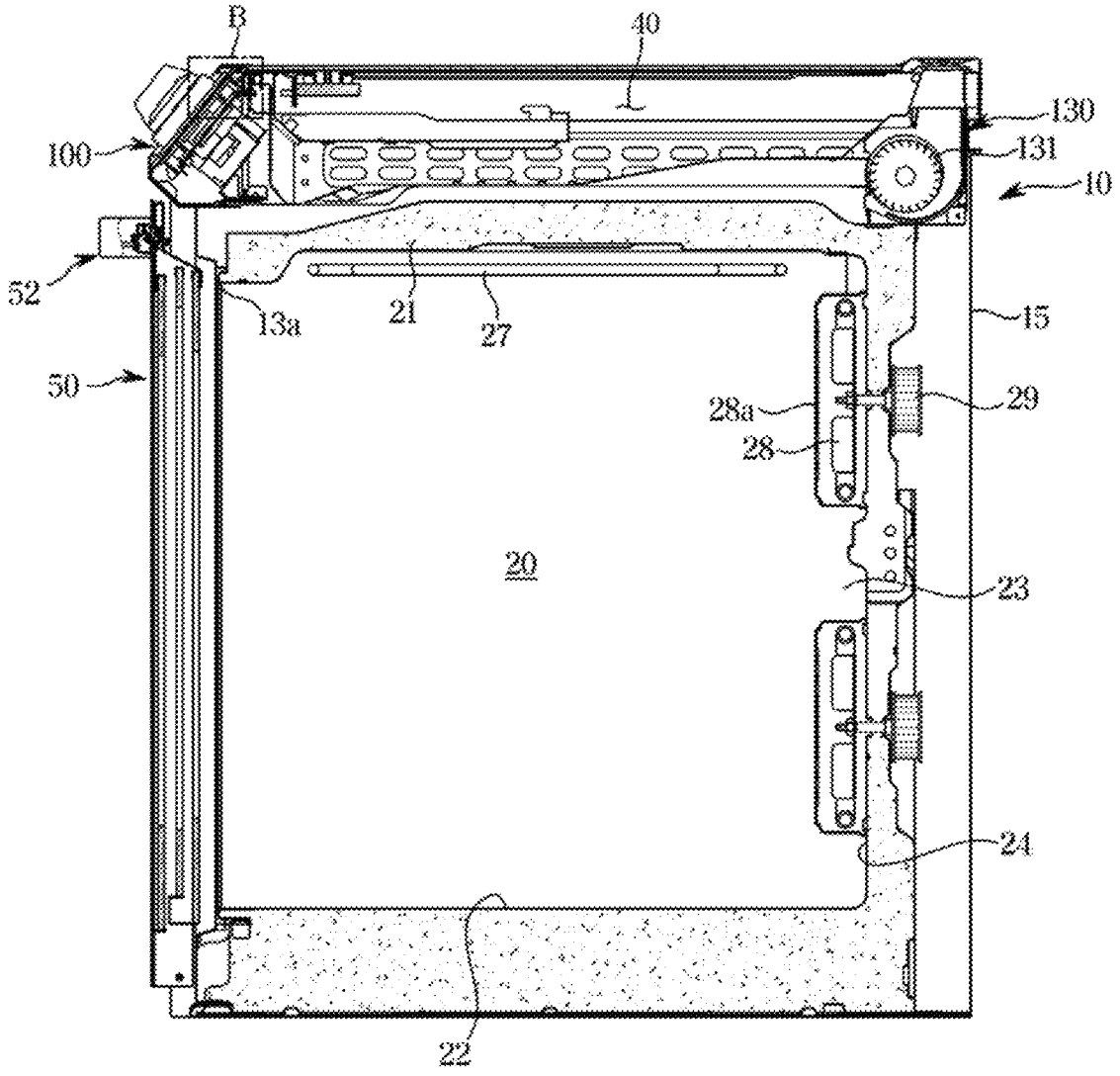
FIG. 3 is a side cross-sectional view of the cooking apparatus shown in FIG. 1.

FIG. 1 shows a cooking apparatus, according to an embodiment of the disclosure. FIG. 2 shows the cooking apparatus shown in FIG. 1 with a door open. FIG. 3 is a side cross-sectional view of the cooking apparatus shown in FIG. 1.

Referring to FIGS. 1 to 3, a cooking apparatus in accordance with an embodiment of the disclosure will now be described.

In FIGS. 1 to 3, a cooking apparatus 1 may include a main body 10 including an inner case 11 defining a cooking room 20 and an outer case 12 coupled with the outside of the inner case 11 and defining the exterior of the cooking apparatus 1.

The inner case 11 and the outer case 12 may each be shaped almost like a box with an open front.

The outer case 12 may include a front panel 13 defining a front surface of the main body 10, side panels 14 defining side surfaces of the main body 10, and a rear panel 15 defining a rear surface of the main body 10.

A main body opening 13*a* may be formed at the front panel 13, making the front side of the cooking room 20 arranged inside the main body 10 opened. In an upper front portion of the front panel 13, a control panel 100 covering the front of an electric room 40 may be arranged. The control panel 100 will be described later in detail.

The cooking room 20 may be defined by a top plate 21, a bottom plate 22, both side plates 23, and a rear plate 24. The front of the cooking room 20 is opened with the opening 13*a* of the front panel 13, through which to put in or taken out a food.

A plurality of supporters 25 may be provided on inner sides of the both side plates 23. At least one rack 26 may be detachably mounted on the plurality of supporters 25 to put foods thereon.

Rails (not shown) may be installed at the plurality of supporters 25 for the rack 26 to slide on the supporters 25. The user may take out or put in a food by shifting the rack 26 on the rail.

A divider (not shown) may be detachably mounted on the plurality of supporters 25 to divide the cooking room 20. Multiple cooking sections obtained by dividing the cooking room 20 with the divider may not necessarily have the same size but may be different in size.

This may allow the space of the spit cooking room 20 to be variously used as intended by the user. The divider may be formed of an insulating material to insulate the split cooking room 20.

A heater 27 may be provided in the cooking room 20 to heat food, and the heater 27 may be an electric heater including an electric resistor. It is not, however, limited thereto, and the heater 27 may be a gas heater for producing heat by burning a gas. Accordingly, the cooking apparatus 1 may include an electric oven and a gas oven.

A circulation fan 28 to heat food evenly by circulating air in the cooking room 20 and a circulation motor 29 to drive the circulation fan 28 may be provided on the rear plate 24 of the cooking room 20.

A fan cover 28*a* for covering the circulation fan 28 may be provided on the front of the circulation fan 28, and a cover opening 28*b* may be formed at the fan cover 28*a* to allow air to be moved in and out.

Electric parts for operating the cooking apparatus 1 may be arranged in the electric room 40. The electric room 40 may be arranged above the cooking room 20.

There may be an insulation member 21 arranged between the electric room 40 and the cooking room 20 to insulate the electric room 40 and the cooking room 20 to prevent hot air in the cooking room 20 from being transferred to the electric room 40. The insulation member 21 may cover not only a space between the electric room 40 and the cooking room 20 but also the outside of the cooking room 20 on the whole to prevent the hot air from being transferred to the outside of the cooking apparatus 1.

The open front of the cooking room 20 may be opened or closed by a door 50, and the door 50 may be coupled with the main body 10 through a hinge 51 provided on a lower portion of the main body 10 to turn against the main body 10. The door 50 rotatably coupled to the front of the main body 10 to open or close the cooking room 20 may be formed of a plurality of glasses.

A door handle 52 may be arranged in an upper front portion of the door 50 for the user to grab the door handle 52 to open or close the cooking room 20 with the door 50.

The cooking apparatus 1 may include a cooktop 30 arranged on the top of the cooking apparatus 1 to put a container with a food thereon and heat them. The cooktop 30 may be equipped with at least one burner 31. The container with a food placed on the burner 31 may be directly heated.

The cooktop 30 of the cooking apparatus 1 and the heater 27 arranged in the cooking room 20 may be collectively called a heating device 27 and 30.

The control panel 100 may be configured to control the heating device 27 and 30. The control panel 100 may be arranged in at least a portion of the main body 10. In an embodiment of the disclosure, the control panel 100 may be arranged at a top end of the front surface of the main body 10. It is not, however, limited thereto, and the control panel 100 may be arranged on the top surface of the main body 10 or may form a side of the main body 10.

The control panel 100 may include a knob 101 to operate the cooking apparatus 1. The knob 101 may operate the cooktop 30. In an embodiment of the disclosure, there may be five knobs 101. However, the number of the knobs 101 is not limited thereto. The number of knobs 101 may correspond to the number of burners 31.

The control panel 100 may include an input device 102 to operate the cooking apparatus 1. The input device 102 may operate the heater 27 in the cooking room 20. In an embodiment of the disclosure, the input device 102 may be provided in a type that operates along with rotation of the knob 101, a button type that operates when pressed, or in a touch screen type.

A display module (not shown) may be mounted on the control panel 100. The display module may be provided to enable touch inputs.

Temperature inside the electric room 40 may rise due to heat from many different electric parts 41 (see FIG. 12), so a wind blower 130 may be equipped in the cooking apparatus 1 to cool down the electric room 40 by circulating air around the electric room 40.

The wind blower 130 may include a blower fan 131 for forcing air to move around. The control panel 100 may include an inlet 106 (see FIG. 10) through which outside air is sucked in by the blower fan 131. The main body 10 may include an outlet 80, and the outside air brought in through the inlet 106 cools down the electric parts 41 of the electric room 40 and is discharged out through the outlet 80. With this structure, the cooking apparatus 1 in accordance with an embodiment of the disclosure may efficiently cool down the electric parts 41 of the electric room 40.

The blower fan 131 may suck in air in an axial direction and discharge the air in a radial direction. For example, the blower fan 131 may be a centrifugal fan. Alternatively, the blower fan 131 may be an axial flow fan.

Figure 4:
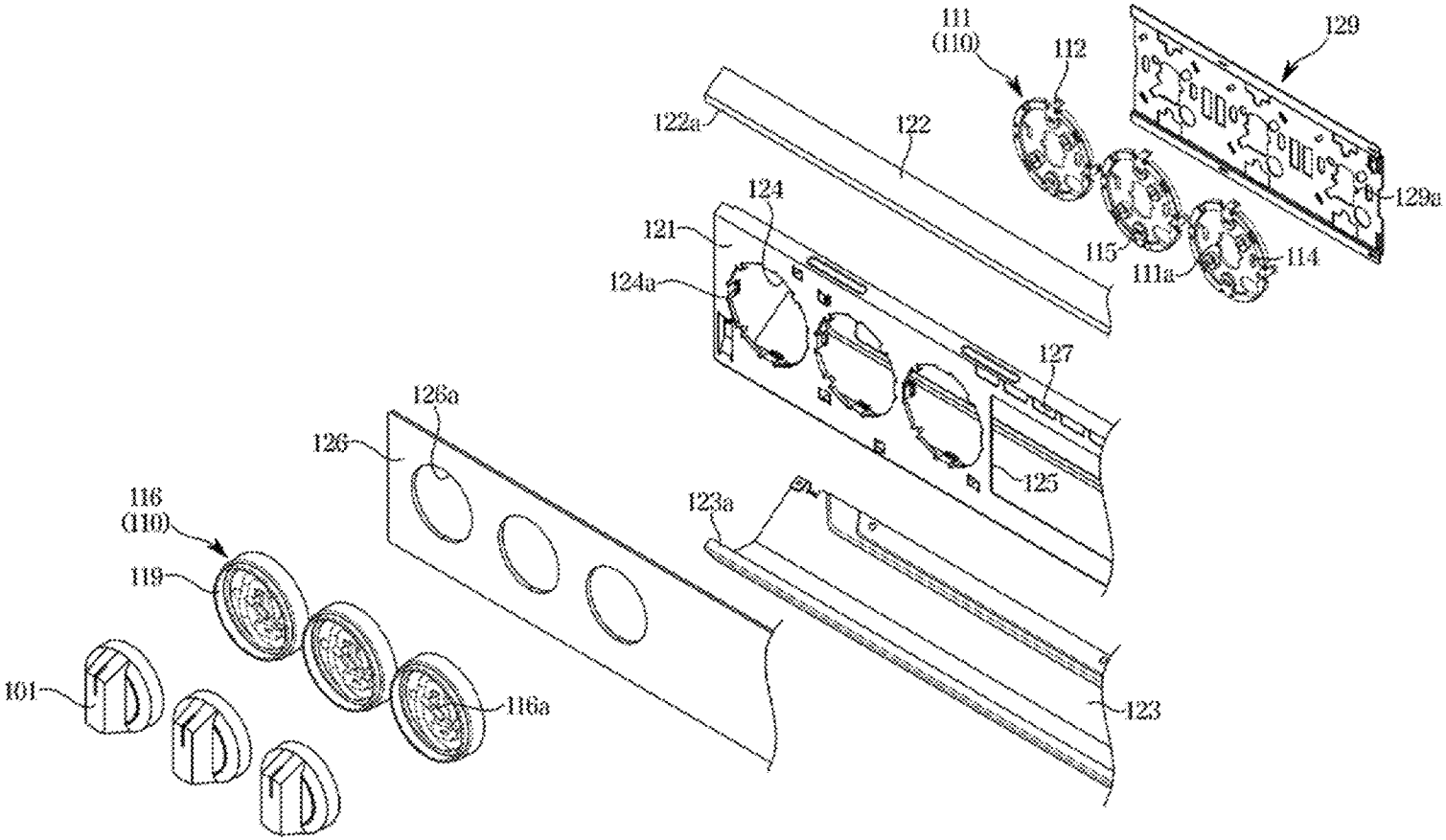
FIG. 4 is an exploded view of a portion of a control panel shown in FIG. 1.

FIG. 4 is an exploded view of a portion of the control panel 100 shown in FIG. 1.

In FIG. 4, a portion on the left of the control panel 100 is shown, and a portion on the right of the control panel 100 may be formed almost the same as the left portion except that the right portion includes a different number of knobs 101 and an associated structure.

The control panel 100 may include a panel assembly 120, knob holders 110 coupled to the panel assembly 120, and the knobs 101 received in the knob holders 110.

The panel assembly 120 may include a panel chassis 121, cover chassis 122 and 123, a glass panel 126, and a panel bracket 129.

The panel chassis 121 may be formed to include a rigid material. The panel chassis 121 may be formed to include a stronger material than for the glass panel 126. The panel chassis 121 may be provided to support the glass panel 126. The panel chassis 121 may reinforce strength of the glass panel 126. The panel chassis 121 may be covered by the glass panel 126. The panel chassis 121 may be arranged not to be exposed to the outside. Hence, the panel chassis 121 may be formed to include a relatively cheap material as compared to the cover chassis 122 and 123 exposed to the outside.

The panel chassis 121 may include holder installation parts 124, at which the knob holders 110 are installed. The holder installation parts 124 may be formed by boring through the panel chassis 121 in a front-rear direction. The holder installation part 124 is formed for a portion of the knob holder 110 to pass through. The holder installation parts 124 may be formed on at least one side to an input device installation part 125.

The holder installation part 124 may include a bracket coupler **124*a* to be coupled with a holder bracket 111 of the knob holder 110. The bracket coupler 124*a* may extend rearwards for the holder bracket 111 to be installed. The bracket coupler 124*a* may be coupled to the holder bracket 111 by hooking the holder bracket 111. Accordingly, the holder bracket 111 may be fixed to the panel chassis 121. As the holder bracket 111 is coupled to a holder case 116 while fixed to the panel chassis 121, the glass panel 126** may be securely supported.

The panel chassis 121 may include the input device installation part 125 at which the input device 102 is installed. The input device installation part 125 may be arranged at almost a center portion of the panel chassis 121. In a case that a display is provided on the control panel 100 of the cooking apparatus 1, the display may display information exposed to the outside through the input device installation part 125.

The panel chassis 121 may include cooling slits 127 formed at the top end at which the first chassis 122 of the cover chassis 122 and 123 is coupled. The cooling slits 127 may guide the outside air brought in through the inlet 106 to the electric room 40. The cooling slits 127 may be located to correspond to where the electric parts 41 are arranged, to make the outside air effectively exchange heat with the electric parts 41 of the control panel 100.

The cover chassis 122 and 123 may include the first chassis 122 and the second chassis 123. The cover chassis 122 and 123 are exposed to the user. The cover chassis 122 and 123 may be formed to include stainless steel.

The first chassis 122 may be coupled to the top end of the panel chassis 121. The first chassis 122 may be arranged to support a top end of the glass panel 126. The first chassis 122 may include a first chassis supporter **122*a* for supporting the glass panel 126. The first chassis supporter 122*a* may bend and extend towards the glass panel 126**.

The first chassis 122 may define the inlet 106 together with the panel chassis 121. The inlet 106 will be described later in detail.

The second chassis 123 may be coupled to a bottom end of the panel chassis 121. The second chassis 122 may be arranged to support a bottom end of the glass panel 126. The second chassis 123 may include a second chassis supporter 123*a* for supporting the glass panel 126. The second chassis supporter 123*a* may bend and extend towards the glass panel 126.

The glass panel 126 may be arranged on the front of the panel chassis 121. The glass panel 126 may be attached to the panel chassis 121 by an adhesive. The glass panel 126 attached to the panel chassis 121 may be supported by the panel chassis 121 and the cover chassis 122 and 123. For example, the glass panel 126 may be coupled to and supported by the panel chassis 121 and the cover chassis 122 and 123 without using a fastening member.

The glass panel 126 may be formed to include a heat-tolerant material. The glass panel 126 may be formed to include a transparent material. The glass panel 126 may be arranged to cover almost all of the front surface of the panel chassis 121. The glass panel 126 may even cover a portion of the panel chassis 121 where the knob holder 110 is installed. The glass panel 126 may be supported by the knob holder 110 on both the front and rear sides.

The glass panel 126 may include holder coupling holes 126*a* into which the knob holders 110 are coupled. A portion of the holder bracket 111 may bore through the holder coupling hole 126*a* and coupled to the holder case 116. A portion of the holder case 16 may bore through the holder coupling hole 126*a* and coupled to the holder bracket 111.

The holder coupling hole 126*a* may be formed to be smaller than the circumference of the knob holder 110. In the conventional structure in which a knob holder bores through a holder coupling hole to be settled at the glass panel, the holder coupling hole of the glass panel needs to be formed in a larger size than the knob holder. As the holder coupling hole grows in size, a possibility of cracks occurring when the holder coupling hole is processed at the glass panel increases.

On the contrary, as for the cooking apparatus 1 in accordance with the embodiment of the disclosure, the knob holder 110 is divided into two parts: the holder bracket 111 and the holder case 116, which are coupled to the glass panel from the front and back, respectively, so the holder coupling hole 126*a* of the glass panel 126 may not need to be larger than the knob holder 110. That is, the size of the holder coupling hole 126*a* may be reduced than in the conventional structure, and accordingly, the possibility of cracks occurring when the holder coupling hole 126*a* is processed at the glass panel 126 may be reduced.

The panel bracket 129 may be coupled to the rear side of the panel chassis 121. The panel bracket 129 may support the holder bracket 111 of the knob holder 110 from the back. The panel bracket 129 may even support the electric parts 41. The panel bracket 129 may include an opening 129*a* formed for a valve (not shown) to be connected to the knob 101 to pass through.

The knob holder 110 may be provided to receive a portion of the knob 101. The knob holder 110 may include the holder bracket 111 and the holder case 116.

The holder bracket 111 may be arranged behind the glass panel 126. The holder bracket 111 may be coupled and fixed to the panel chassis 121. The holder bracket 111 may include a bracket fixer 112 to be coupled to the panel chassis 121. The bracket fixer 112 may have the form of a hook. The holder bracket 111 may include an opening 111*a* formed for the valve to be connected to the knob 101 to pass through.

The holder bracket 111 may include a bracket fastening part 114. As the bracket fastening part 114 of the holder bracket 111 and a holder fastening part 118 of the holder case 116 are coupled to each other by a fastening member (not shown), the holder case 116 may be coupled and fixed to the holder bracket 111.

The holder bracket 111 may include a bracket installation part 115. As a holder coupler 117 of the holder case 116 is installed at the bracket installation part 115, the holder case 116 may be primarily coupled to the holder bracket 111.

The holder case 116 may be arranged in front of the glass panel 126. The holder case 116 may be coupled and fixed to the holder bracket 111. The holder case 116 may include an opening 116*a* formed for the valve to be connected to the knob 101 to pass through.

The bracket installation part 115 and the holder coupler 117 may be located outside of edges of the opening 111*a* of the holder bracket 111 and the opening 116*a* of the holder case 116, respectively.

The holder case 116 and the holder bracket 111 may be coupled to each other with the glass panel 126 in between. While the holder case 116 and the holder bracket 111 are coupled to each other, the knob holder 110 may support the glass panel 126 from the front and back of the glass panel 126. Accordingly, the glass panel 126 may be more securely fixed to the panel chassis 121.

The holder case 116 may include a knob receiver 119 to receive the knob 101. The knob 101 may be turned and/or moved while received in the knob receiver 119. The knob receiver 119 may be formed to cover at least a portion of edges of the knob 101. Accordingly, the control panel 100 of the cooking apparatus 1 may have an enhanced design.

Figure 5:
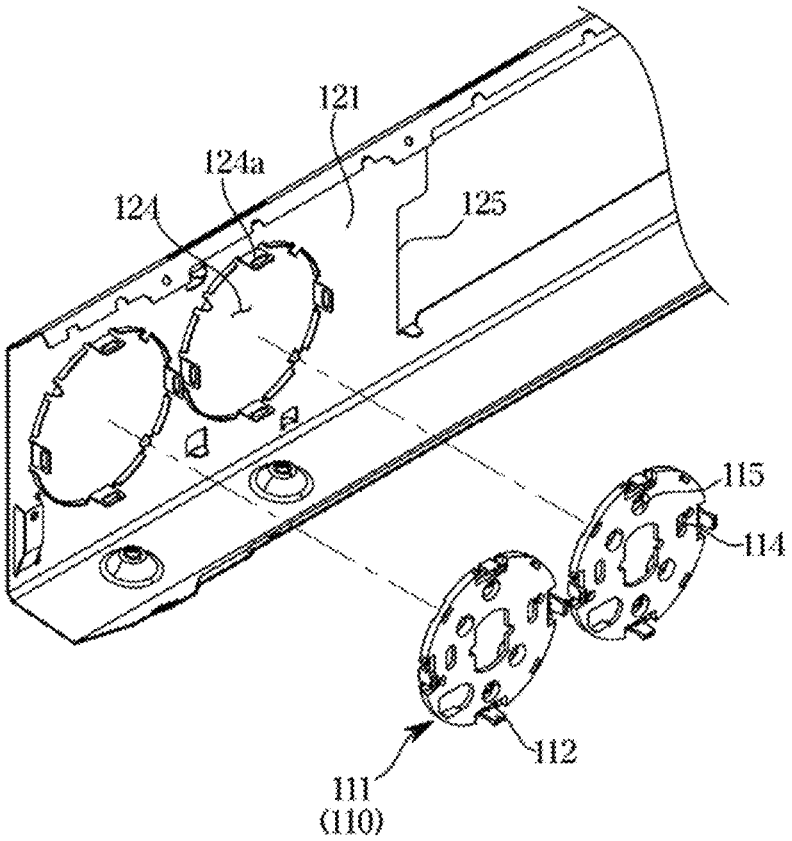
FIG. 5 shows a holder bracket being coupled to a panel chassis shown in FIG. 4.
Figure 6:
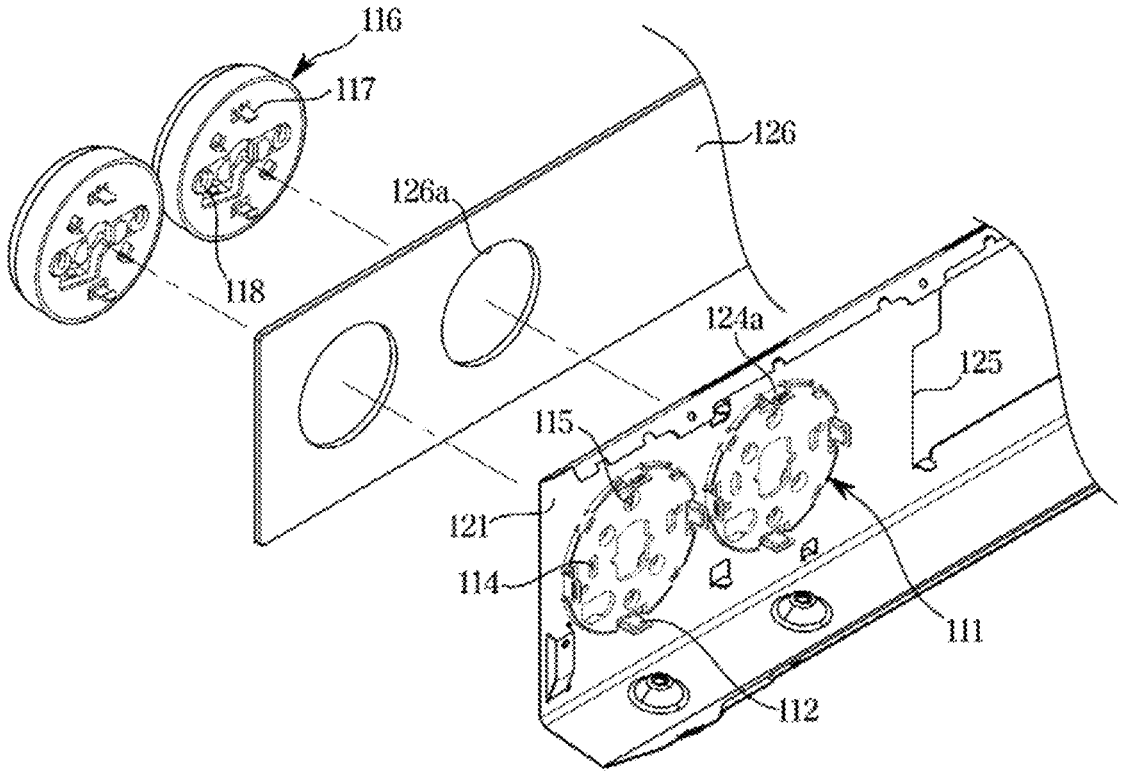
FIG. 6 shows a glass panel and a holder case being coupled to the panel chassis shown in FIG. 5.
Figure 7:
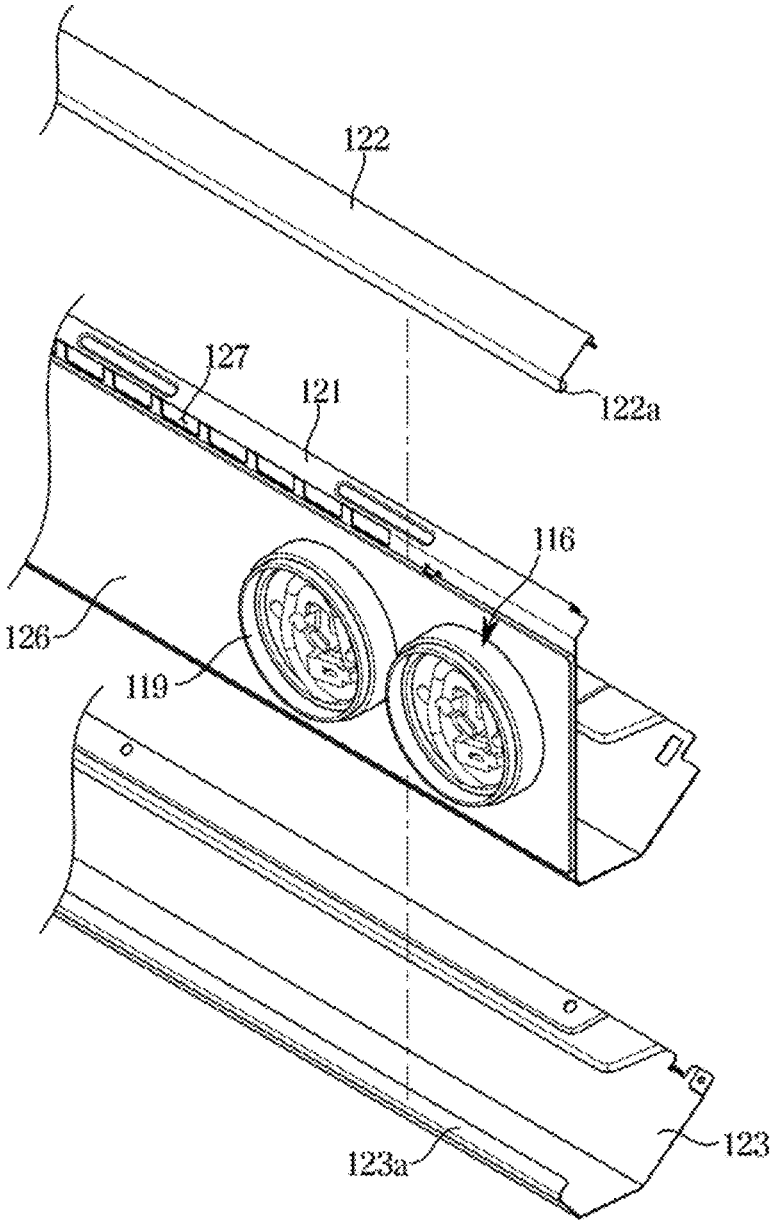
FIG. 7 shows a cover chassis being coupled to the panel chassis shown in FIG. 6.
Figure 8:
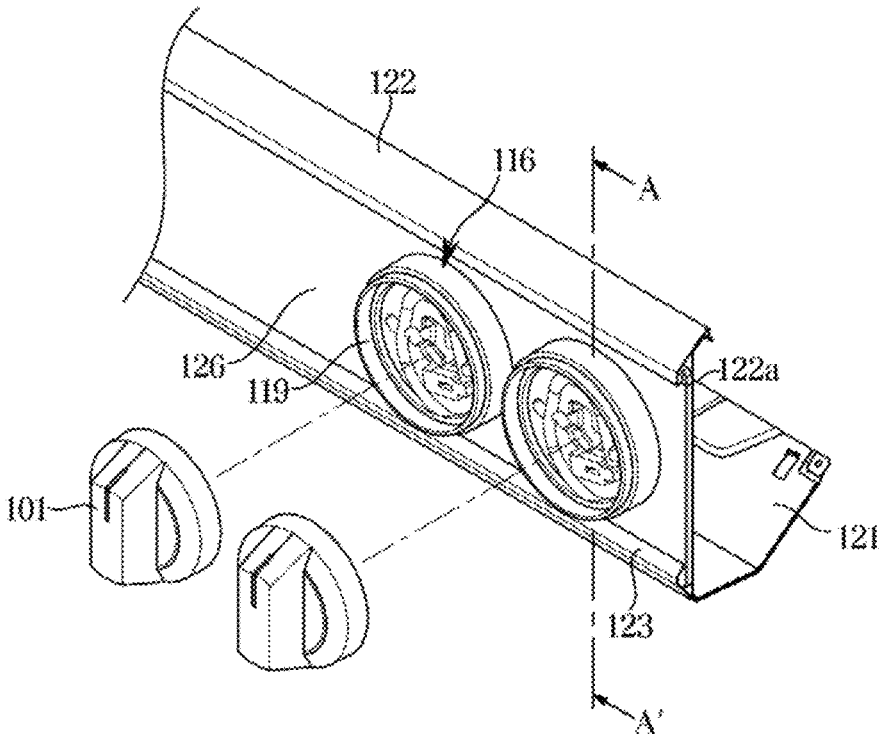
FIG. 8 shows knobs being received in knob holders shown in FIG. 7.
Figure 9:
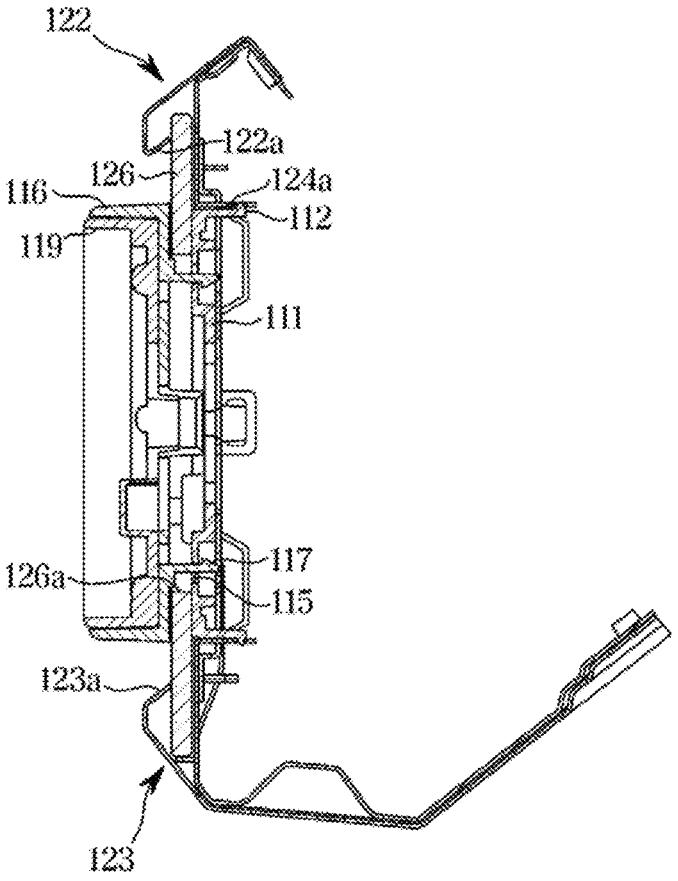
FIG. 9 is a cross-sectional view along line A-A' marked in FIG. 8.

FIG. 5 shows the holder bracket 111 being coupled to the panel chassis 121 shown in FIG. 4. FIG. 6 shows the glass panel 126 and the holder case 116 being coupled to the panel chassis 121 shown in FIG. 5. FIG. 7 shows the cover chassis 122 and 123 being coupled to the panel chassis 121 shown in FIG. 6. FIG. 8 shows knobs 101 being received in knob holders 110 shown in FIG. 7. FIG. 9 is a cross-sectional view along line A-A' marked in FIG. 8.

Referring to FIGS. 5 to 8, an assembly process of the control panel 100 in accordance with an embodiment of the disclosure will now be described.

Referring to FIG. 5, first, the holder bracket 111 may be coupled and fixed to the panel chassis 121. The bracket fixer 112 of the holder bracket 111 may be coupled to the bracket coupler 124*a* of the panel chassis 121 by hooking the bracket coupler 124*a*.

Referring to FIG. 6, the glass panel 126 may be primarily mounted with an adhesive on the panel chassis 121 coupled with the holder bracket 111.

Subsequently, the holder case 116 may be coupled to the holder bracket 111 from the front of the glass panel 126. Specifically, the holder case 116 may be primarily fixed by the holder coupler 117 to the holder bracket 111 by hooking. The holder case 116 primarily fixed to the holder bracket 111 may be secondarily fixed to the holder bracket 111 by screwing as the holder fastening part 118 of the holder case 116 and the bracket fastening part 114 of the holder bracket 111 are fastened together with a fastening member (not shown).

Referring to FIG. 7, the cover chassis 122 and 123 may be mounted on the panel chassis 121 after the glass panel 126 and the knob holder 110 are completely mounted on the panel chassis 121. Specifically, the first chassis 122 may be mounted at the top end of the panel chassis 121, and the second chassis 123 may be mounted at the bottom end of the panel chassis 121. The first chassis 122 may be arranged to support the top end of the glass panel 126, and the second chassis 123 may be arranged to support the bottom end of the glass panel 126.

Accordingly, the panel chassis 121 may have all portions, which might otherwise be exposed to the outside, covered by the glass panel 126, the first chassis 122, and the second chassis 123. Hence, the panel chassis 121 may be formed to include a relatively cheap material as compared to the cover chassis 122 and 123 exposed to the outside.

Referring to FIG. 8, the panel chassis 121 equipped with the glass panel 126, the knob holders 110, and the cover chassis 122 and 123 may be mounted on the main body 10 to cover the front of the electric room 40 where a valve (not shown) is placed. Accordingly, a valve shaft (not shown) of the valve may pass through the knob holder 110 and protrude even to the knob receiver 119, and the knob 101 may have a portion inserted to the knob receiver 119 and may be coupled to the valve shaft.

Referring to FIG. 9, the holder coupler 117 of the holder case 116 may pass through the holder coupling hole 126*a* and may be coupled to the bracket installation part 115 of the holder bracket 111. Accordingly, the holder bracket 111 and the holder case 116 may support the glass panel 126 on both front and rear sides.

Furthermore, the top end of the glass panel 126 may be supported by the first chassis supporter 122*a* of the first chassis 122, and the bottom end of the glass panel 126 may be supported by the second chassis supporter 123*a* of the second chassis 123. Moreover, the glass panel 126 may extend to the space between the first chassis 122 and the panel chassis 121, and between the second chassis 123 and the panel chassis 121, in which case the size of the glass panel 126 may increase, thereby reducing a possibility of cracks occurring when the holder coupling hole 126*a* is processed.

Figure 10:
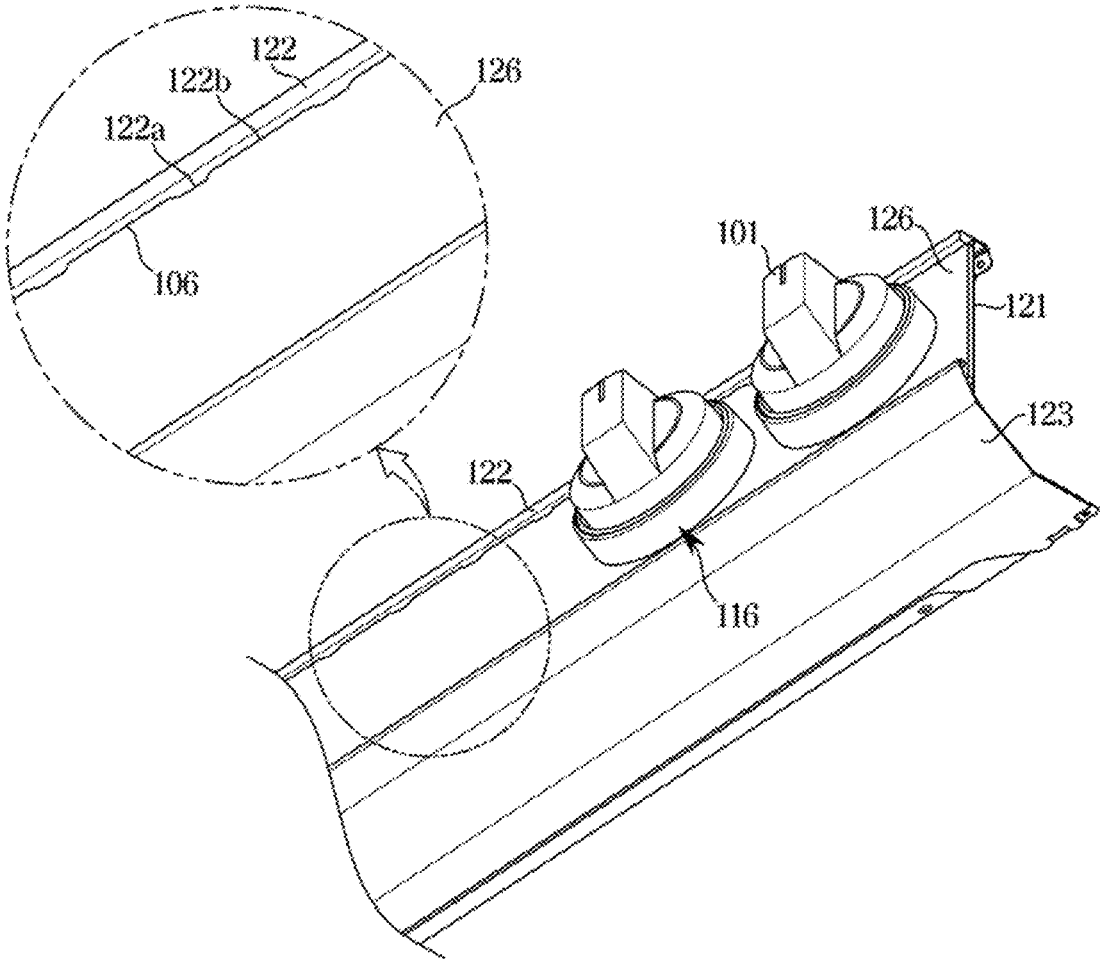
FIG. 10 shows the knobs received in the knob holders shown in FIG. 8 from underneath.
Figure 11:
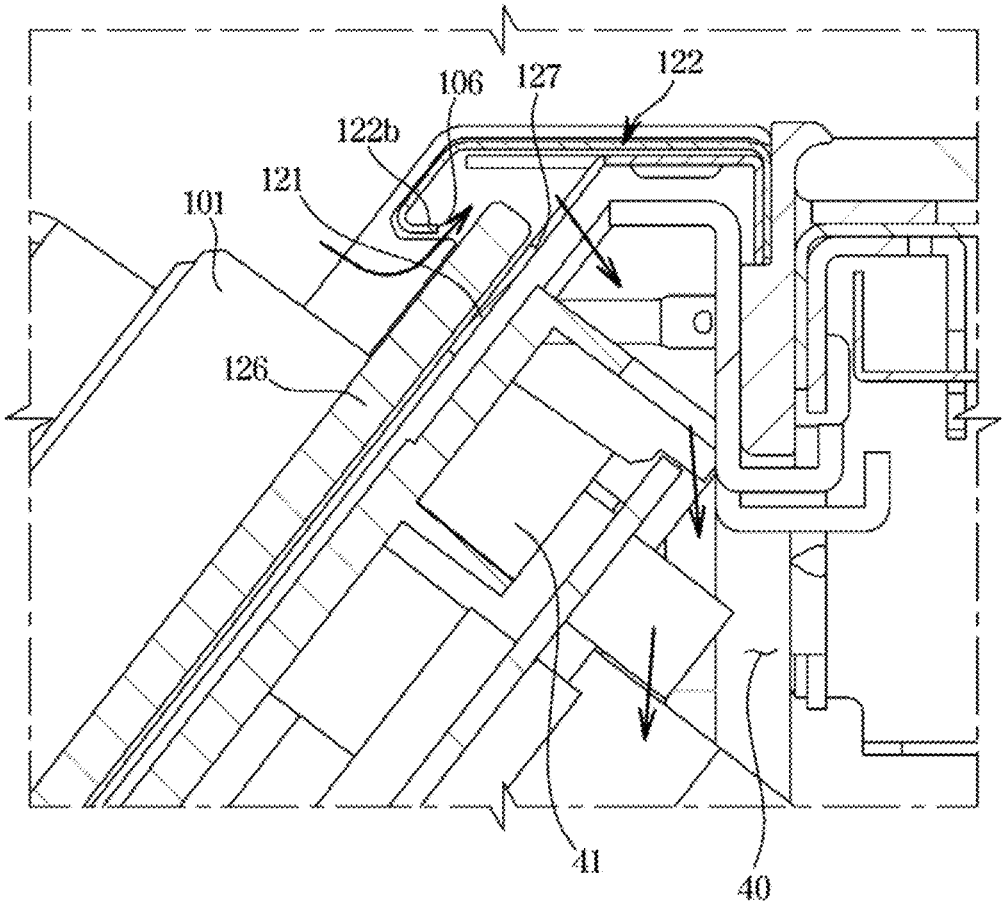
FIG. 11 is an enlarged view of portion 'B' marked in FIG. 3.
Figure 12:
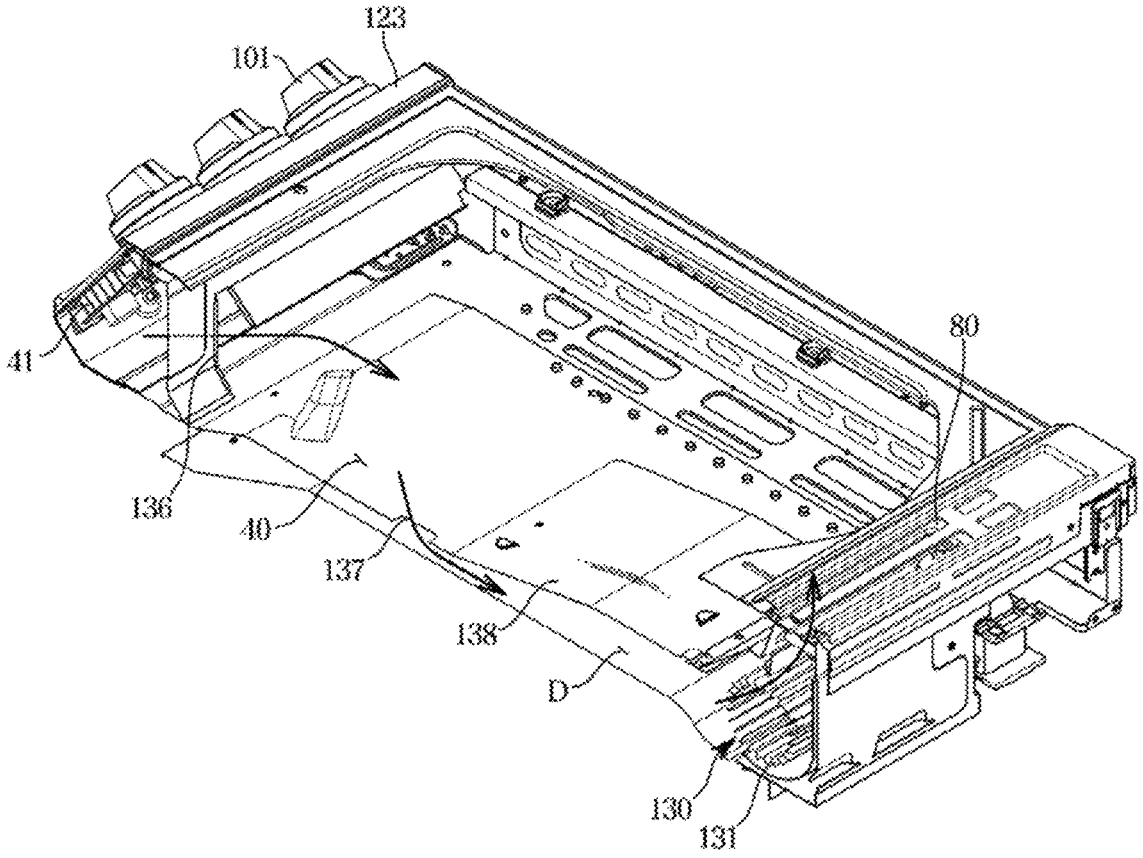
FIG. 12 is a partial cross-sectional view of a heat dissipating path inside an electric room shown in FIG. 3.

FIG. 10 shows the knobs received in the knob holders shown in FIG. 8 from underneath. FIG. 11 is an enlarged view of portion 'B' marked in FIG. 3. FIG. 12 is a partial cross-sectional view of a heat dissipating path inside the electric room shown in FIG. 3.

Referring to FIGS. 10 to 12, a structure for cooling down the electric parts 41 arranged near the control panel 100 of the cooking apparatus 1 in accordance with an embodiment of the disclosure will now be described.

Referring to FIGS. 10 to 12, the inlet 106 may be formed almost at a center portion of the length of the control panel 100. The inlet 106 may be located above the input device 102. The inlet 106 may be formed as an end of the first chassis 122 is separated from the glass panel 126. The inlet 106 may be located to correspond to the electric parts 41 mounted on the control panel 100. Accordingly, air brought in through the inlet 106 may effectively cool down the electric parts 41.

The inlet 106 may be formed towards the direction of gravity. The inlet 106 may be formed downwards. The inlet 106 may be located in a portion where the first chassis 12 and the glass panel 126 join. Hence, the inlet 106 may be provided not to be exposed to the user.

Referring to FIG. 10, the first chassis 122 may include the first chassis supporter 122*a* to support the glass panel 126, and a blocking portion 122*b* separated from the glass panel 126 by a certain distance to form the inlet 106. At the first chassis 122, the first chassis supporter 122*a* and the blocking portion 122*b* may be alternately formed within a certain interval in the almost the center portion of the length of the first chassis 122. However, only the first chassis supporter 122*a* may run and the blocking portion 122*b* may be omitted at both ends of the center portion in which the first chassis supporter 122*a* and the blocking portion 122*b* are alternatively arranged.

The blocking portion 122*b* may extend almost horizontally. As the first chassis 122 includes the blocking portion 122*b* in a form that bends at the front end and extends backwards, the first chassis 122 may prevent the inlet 106 from being exposed to the outside and foreign materials from being brought in through the inlet 106. With the blocking portion 122*b* separated from the glass panel 126 by a certain distance, the inlet 106 may be formed between the first chassis 122 and the glass panel 126.

When the blower fan 131 of the wind blower 130 operates, air brought in through the inlet 106 may flow into the electric room 40 through the cooling slit 127 of the panel chassis 121. The air flowing into the electric room 40 may cool down the electric parts 41 mounted on the control panel 100 by exchanging heat with them. The air flowing into the electric room 40 may cool down electric parts adjacent to the control panel 100.

The air having cooled down the electric parts 41 is moved backwards through a guide opening 136 formed at the main body 10. The guide opening 136 may be located on either side of the center portion of the control panel 100, in which the inlet 106 and the cooling slit 127 are formed. With this structure, the air brought in through the inlet 106 and the cooling slit 127 may exchange heat with the electric parts 41 on the whole arranged on the rear side of the control panel 100, and may then be moved toward the outlet 80.

The air passing through the guide opening 136 and moving backwards flows into a discharging flow path D formed by a discharging cover 138 through a flow path entrance 137. The air flowing in the discharging flow path D may pass the blower fan 131 and may be discharged through the outlet 80 formed at the top of the rear side of the main body 10.

According to an embodiment of the disclosure, a cooking apparatus may include a glass panel defining the front surface of a control panel and extending to an area where a knob is arranged to enhance a design.

According to an embodiment of the disclosure, a cooking apparatus may include a knob holder formed with two or more parts and coupled to a glass panel on both sides, allowing reduction in size of a holder coupling hole of the glass panel and thus reducing defective rates of the glass panel and saving the cost.

According to an embodiment of the disclosure, a cooking apparatus may include a control panel with an inlet formed thereon, through which to bring in outside air to exchange heat with electric parts inside the control panel, thereby efficiently cooling the electric parts.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. A cooking apparatus comprising:

a main body forming an electric room; and a control panel configured to control a heating device, wherein the control panel includes:

a glass panel, a panel chassis arranged to support the glass panel, a first chassis coupled to a top end of the panel chassis to support a top end of the glass panel, a knob holder including a holder bracket arranged on a rear side of the glass panel and a holder case coupleable to the holder bracket and arranged on a front side of the glass panel such that while the holder case is coupled to the holder bracket, the glass panel is between the holder bracket and the holder case, and a knob having a portion to be received in the knob holder, wherein the first chassis extends from the panel chassis over the top end of the glass panel and back toward the glass panel, and includes:

a first chassis supporter extending back toward the glass panel to support the glass panel, and a blocking portion alternately formed with the first chassis supporter and separated from the glass panel, and forming an inlet together with the first chassis supporter and the front side of the glass panel, wherein the top end of the glass panel extends higher than the inlet, and wherein the inlet is formed so that air is passable through the inlet and over the top end of the glass panel to the electric room.

2. The cooking apparatus of claim 1, wherein the glass panel comprises a holder coupling hole formed for the knob holder to be coupled to the glass panel, and wherein a circumference of the holder coupling hole is smaller than a circumference of the knob holder.

3. The cooking apparatus of claim 1, wherein the knob holder is arranged to support the glass panel on both the rear side and the front side of the glass panel.

4. The cooking apparatus of claim 1, wherein the holder case comprises a knob receiver formed to cover at least the portion of the knob received in the holder case, and the portion of the knob received in the holder case is a portion of edges of the knob.

5. The cooking apparatus of claim 1, wherein the holder case includes a holder coupler, and wherein the holder bracket is coupled to the holder coupler, and the holder bracket includes a bracket installation part located outside of edges of the opening.

6. The cooking apparatus of claim 1, wherein the holder bracket is fixed to the panel chassis.

7. The cooking apparatus of claim 1, wherein the control panel comprises:

a second chassis coupled to a bottom end of the panel chassis to support athe bottom end of the glass panel.

8. The cooking apparatus of claim 1, wherein the panel chassis is formed to include a material different from the first chassis and the second chassis.

9. The cooking apparatus of claim 1, wherein the main body comprises an outlet formed at an end opposite another end of the main body at which the control panel is arranged, and wherein a wind blower is arranged on a flow path connecting the inlet and the outlet for circulating air.

10. The cooking apparatus of claim 9, wherein the inlet is formed towards a direction of gravity.

11. The cooking apparatus of claim 9, wherein the panel chassis comprises a cooling slit formed to guide air brought in through the inlet to the electric room.

12. The cooking apparatus of claim 1, wherein the inlet is formed at a location corresponding to where electric parts are arranged in the electric room.

13. A cooking apparatus comprising:

a control panel configured to control a heating device, wherein the control panel includes:

a glass panel, a panel chassis arranged to support the glass panel, a first chassis coupled to a top end of the panel chassis to support a top end of the glass panel, a second chassis coupled to a bottom end of the panel chassis to support a bottom end of the glass panel, a knob holder fixed to the panel chassis and arranged to support the glass panel on a front side of the glass panel and a rear side of the glass panel, and a knob having a portion to be received in the knob holder, and wherein the first chassis extends from the panel chassis over the top end of the glass panel and back toward the glass panel, and includes:

a first chassis supporter extending back toward the glass panel to support the glass panel, and a blocking portion alternately formed with the first chassis supporter and separated from the glass panel, and forming an inlet together with the first chassis supporter and the front side of the glass panel, wherein the top end of the glass panel extends higher than the inlet, and wherein the inlet is formed so that air is passable through the inlet and over the top end of the glass panel to an area behind the control panel.

14. The cooking apparatus of claim 13, wherein the inlet is formed towards a direction of gravity.

15. The cooking apparatus of claim 14, wherein the inlet is arranged to correspond to a location of an electric part mounted on the control panel.

16. The cooking apparatus of claim 13, wherein the glass panel comprises a holder coupling hole formed for the knob holder to be coupled to the glass panel, and wherein a circumference of the holder coupling hole is smaller than a circumference than the knob holder.

* * * * *